United States Patent [19]

Vesperman et al.

[11] Patent Number: 4,541,208

[45] Date of Patent: Sep. 17, 1985

[54] INSULATING COVER FOR PULL DOWN STAIRS

[76] Inventors: William C. Vesperman, 1919 Cypress Dr., Bel Air, Md. 21014; Max K. Wilson, 10811 Lakespring Way, Cockeysville, Md. 21030

[21] Appl. No.: 514,845

[22] Filed: Jul. 18, 1983

[51] Int. Cl.[4] ..... E04D 13/08

[52] U.S. Cl. ..... 52/19; 52/72; 182/77

[58] Field of Search ..... 52/19, 21, 72; 182/78–81, 77; 292/256.5

[56] References Cited

U.S. PATENT DOCUMENTS

| | | | |
|---|---|---|---|
| 2,321,499 | 6/1943 | Marschke | 182/81 |
| 2,345,394 | 3/1944 | Hogan | 292/256.5 |
| 3,465,483 | 9/1969 | Miller | 52/72 |
| 4,151,894 | 5/1979 | Edwards | 182/77 |

FOREIGN PATENT DOCUMENTS

| | | | |
|---|---|---|---|
| 179372 | 9/1935 | Switzerland | 182/78 |

*Primary Examiner*—James L. Ridgill, Jr.
*Attorney, Agent, or Firm*—Murray, Whisenhunt & Ferguson

[57] ABSTRACT

An insulating cover is disclosed for enclosing an opening in a building floor containing a folding stairs which has a pair of tracks mounted adjacent the opening. An inverted box-like structure of sufficient size to cover the opening has sides which fit and are movable in the tracks to enable the box-like structure to be slid horizontally and/or pivoted to cover or expose the openings.

15 Claims, 6 Drawing Figures

FIG. 3
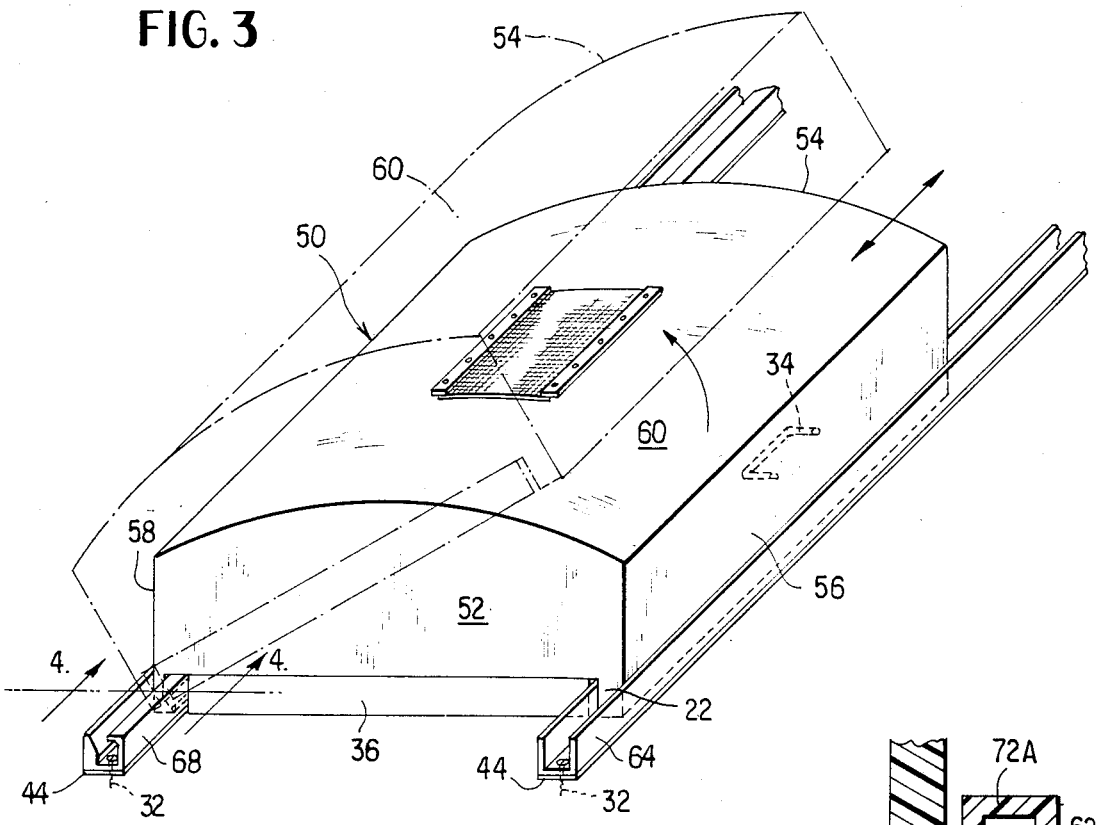
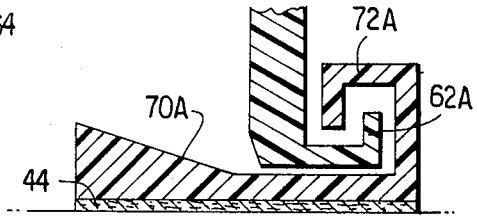
FIG. 5
FIG. 4
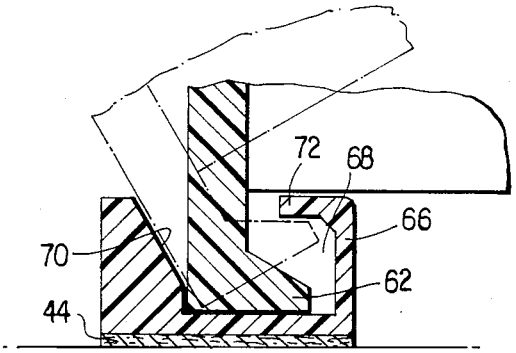
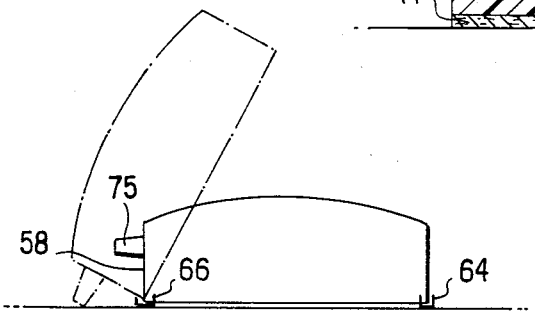
FIG. 6

INSULATING COVER FOR PULL DOWN STAIRS

FIELD OF THE INVENTION

This invention relates generally to covers and more specifically to an insulating cover for an opening containing a folding stairs.

STATEMENT OF THE PRIOR ART AND OBJECTS

Devices for covering the openings through floors containing folding stairs are not new. A typical example of those devices presently existing in the prior art is exemplified by U.S. Pat. No. 4,151,894. While such devices are generally satisfactory for their intended purpose, they have not proved to be entirely acceptable if limited space is available as it often is in attics and the like. Numerous other devices of the prior art are also unsatisfactory due to their complex nature and high cost to manufacture and install. As a result of the shortcomings of devices of the prior art, there exists the need for a cover which is simple and inexpensive in construction, is highly insulative, yet can be opened by movement in more than one direction.

It is therefore the primary object of this invention to provide a superior cover for floor openings of the type containing folding stairs.

It is another object of this invention to provide a cover which can be operated by sliding or mounted for pivoted operation by either the right or left hand.

It is yet another object of this invention to provide a cover which is highly insulative and flame retardant but also has a screen insert to provide ventilation.

It is a still further object of this invention to provide a cover which is inexpensive to manufacture and can be installed over new or existing pull-down stairs.

It is a still further object of this invention to provide a cover which can be easily installed in attics and the like not having solid flooring.

Other objects of this invention and various features of novelty which characterize it are pointed out with particularity in the claims annexed to and forming a part of this disclosure. For a better understanding of this invention, its operating advantages and specific objects attained by its uses, reference should be had to the accompanying drawing and descriptive matter in which there are illustrated preferred embodiments of the invention.

BRIEF DESCRIPTION OF THE DRAWING

In the drawing:

FIG. 3 is a view in perspective of another embodiment of the present invention equipped for hinged operation, and FIG. 4 is a cross-sectional view taken along the lines 4—4 of FIG. 3.

FIG. 5 cross-sectional view of alternate method of FIG. 4

FIG. 6 view showing support member for opened cover

DESCRIPTION OF PREFERRED EMBODIMENTS

Figure 1:
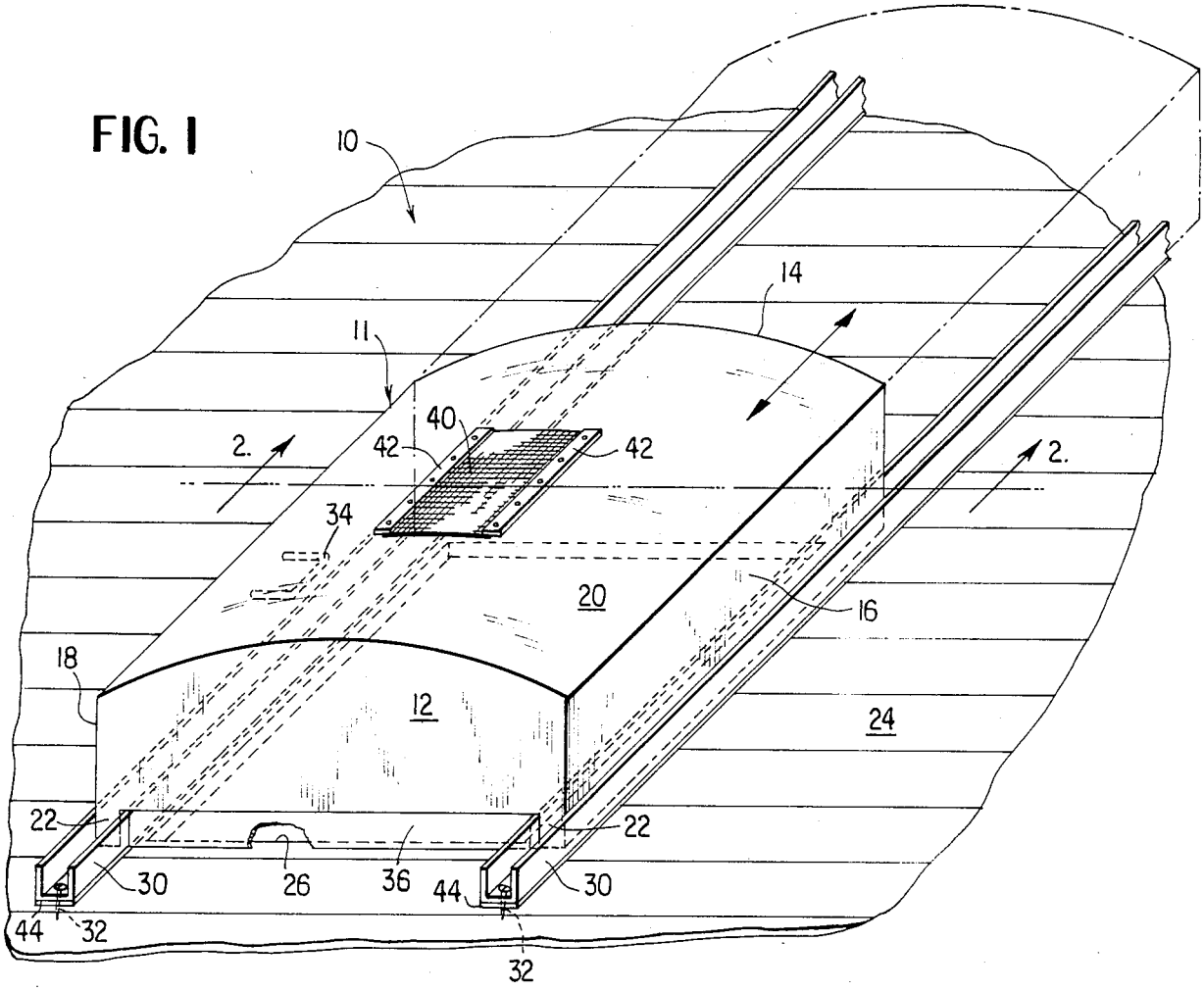
FIG. 1 is a view in perspective of one embodiment of the present invention installed over the opening in a floor.
Figure 2:
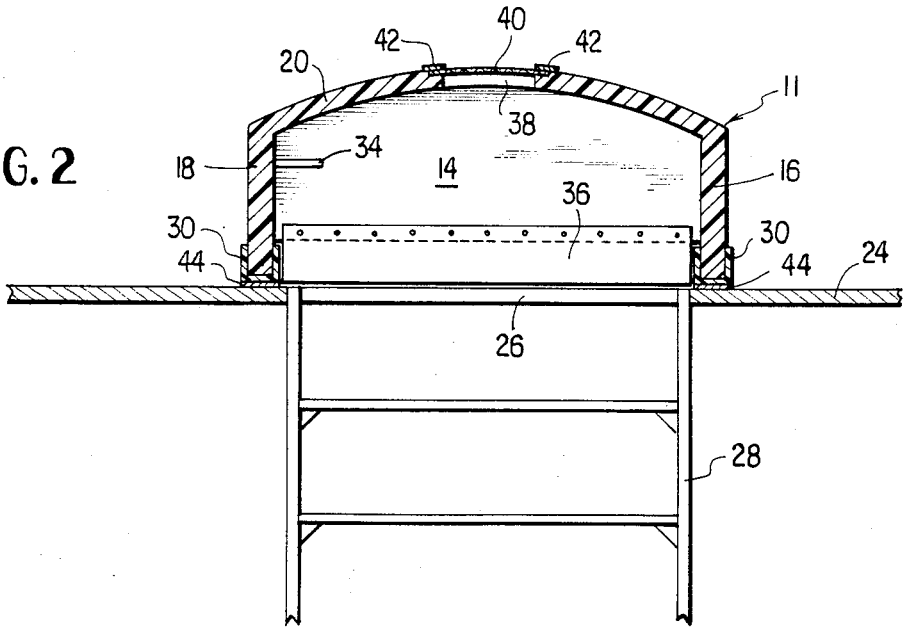
FIG. 2 is a cross-sectional view taken along the lines 2—2 of FIG. 1.

With reference to the drawing and in particular FIGS. 1 and 2, there is shown and illustrated an insulating cover for a pull-down, folding stair construction in accordance with the principles of the invention and designated generally by reference numeral 10. The particular device represented includes an inverted box-like structure 11 having a front wall 12 and a rear wall 14 joined to side walls 16 and 18 and to a top 20 having an upwardly convex curvature. The side walls 16 and 18 extend a distance beyond the front and rear walls 12,14 respectively, in the form of rails 22.

Secured to the floor 24, on either side of an opening 26 therethrough containing a stairs 28 of the pull-down, folding-type are two spaced apart, parallel, U-shaped tracks 30. The tracks 30 can be secured to the floor 24 by nails, screws or the like 32. Preferably, the insulating cover and tracks will be made of fiberglass or other suitable plastic material. The rails 22 are positioned in the tracks 30 and enable the structure 11 to be slid horizontally in either direction by merely grasping the handle 34. A flexible gasket 36 is secured to and depends from the front and rear walls 16,18, respectively, to the floor 24 in the area between tracks 30 to provide sealing against air leakage. The top 20 can also be provided with an opening 38 which contains a removable section of screen 40 to provide ventilation if desired. The screen 40 is held by means of detachable strips 42 or pivotal secured to the top 20. Strips of insulating material 44 are also positioned between the tracks 30 and the floor 24 to further seal against air leakage into the opening 26.

Referring now to FIGS. 3 and 4, and 5 another embodiment of the cover of the present invention, which is capable of both pivoting and sliding, is disclosed also having an inverted box-like structure 50 with a front wall 52 and rear wall 54 joined to side walls 56 and 58 and to top 60. The side walls 56 and 58 extend a distance beyond the front and rear walls 52,54, respectively, in the form of a rail similar to rail 22, however, the rail 58 has a foot-shaped projection 62,62A on the end thereof which faces inwardly. A track 64 is provided for rail 56 to slide in, which is similar to tracks 30. The track 66 is different in cross-sectional configuration than 64 in that it has an opening 68 with an inclined surface 70,70A and a lip 72,72A which enables the projection 62 to pivot in the opening 68 about an axis parallel to track 66 as a hinge for the box-like structure 50. When the box-like structure 50 is rotated to its open position (see phantom lines), the side wall 58 rests against the inclined surface 70,70A and the projection 62,62A engages the lip 72,72A as shown in FIGS. 4 and 5 to maintain the box-like structure 50 in its open position. The bottom corner opposite the foot like projection 62 may be chamfered to promote additional stability in the opened position. In addition a chain or other flexible constraint may be connected between box like structure 50 and the stairway (attic) frame to assist in maintaining its opened position. An additional method of maintaining the box like structure in its open position could be the incorporation of a foot like or fin shaped projection 75 along wall 58, which would rest on the flooring or joists as shown in FIG. 6. The box-like structure 50 can slide in the tracks 64,66 as aforementioned to expose or enclose the opening 26. The top 60 can also be provided with an opening 38 and screen 40.

All the characteristics described and illustrated are essential to the invention singly and in any combination. While specific embodiments of the invention have been shown and described in detail to illustrate the application of the principles of the invention, it will be understood that the invention may be embodied otherwise without departing from such principles.

We claim:

1. An insulating cover adapted to enclose an opening in a building floor containing a folding stairs, said cover comprising:

(a) a pair of tracks connected to the building in spaced apart, parallel relationship to each other adjacent said opening, (b) an inverted box-like structure of sufficient size to cover said opening and having a top, front, rear, and two side walls, said side walls being respectively positioned and slidably connected in each of said tracks whereby to cover or expose said opening, and (c) wherein one of said side walls is pivotally connected in its associated side track and which has a projection at the lower end thereof which extends the length of the said one side wall and which, engages said track to thereby limit the travel of said box-like structure when said box-like structure is pivoted in said track about an axis extending parallel to said track to expose said opening.

2. An insulating cover as set forth in claim 1 wherein said top of said box-like structure has an opening formed through it for ventilation, said opening further having screen means covering said opening.

3. An insulating cover as set forth in claim 1 further comprising handle means secured to at least one of said side walls inside said box-like structure.

4. An insulating cover as set forth in claim 1 further comprising insulating means attached to and movable with said front and rear walls which insulating material extends to said floor to prevent passage of air between said front and rear walls and said floor.

5. An insulating cover as set forth in claim 1 further comprising insulating means between said U-shaped tracks and said floor to prevent the passage of air therebetween.

6. An insulating cover enclosing an opening in a building floor containing a folding stairs, said cover comprising:

(a) a pair of tracks connected to the building in spaced apart, parallel relationship to each other adjacent said opening, (b) an inverted box-like structure of sufficient size to cover said opening and having a top, front, rear and two side walls, said side walls being respectively positioned and slidably connected in each of said tracks whereby said box-like structure can be moved at least horizontally to cover or expose said opening, and (c) one of said side walls being pivotally connected in its associated track for pivotal movement of said box-like structure about an axis extending parallel said associated track so that said opening can also be covered or exposed by said pivotal movement.

7. An insulating cover as set forth in claim 6 wherein said top of said box-like structure has an opening formed through it for ventilation, said opening further having screen means covering said opening.

8. An insulating cover as set forth in claim 6 further comprising handle means secured to at least one of said side walls inside said box-like structure.

9. An insulating cover as set forth in claim 6 further comprising insulating means attached to and movable with said front and rear walls which insulating means extends to said floor to prevent passage of air between said front and rear walls and said floor.

10. An insulating cover as set forth in claim 6 further comprising insulating means between said tracks and said floor to prevent the passage of air therebetween.

11. An insulating cover as set forth in claim 6 where said top of the box-like structure has an upwardly convex curvature.

12. A cover as in claim 6 including means mounted with respect to the box-like structure for limiting the pivotal movement of the box-like structure about said axis through a predetermined angle.

13. A cover as in claim 12 where said limiting means includes a projection extending from the outer surface of said one side wall.

14. A cover as in claim 12 where said limiting means includes a projection at the lower end of the one side wall, said projection extending the length of said one side wall whereby the projection engages the track to limit the pivotal movement of the box-like structure.

15. A cover as in claim 14 where said limiting means includes a lip connected to and extending from an upper portion of said associated track so that said projection engages said lip to effect said limitation of the pivotal movement.

* * * * *